United States Patent [19]

Broski, Jr.

[11] 4,422,622

[45] Dec. 27, 1983

[54] PREFABRICATION FENCE PANEL CONSTRUCTION FOR DOG KENNELS AND THE LIKE

[75] Inventor: Stanley M. Broski, Jr., Kansas City, Mo.

[73] Assignee: Merchants Metals, Inc., Forth Worth, Tex.

[21] Appl. No.: 332,498

[22] Filed: Dec. 21, 1981

[51] Int. Cl.[3] ..... E04H 17/16

[52] U.S. Cl. ..... 256/25; 119/20; 256/73

[58] Field of Search ..... 256/73, 25, 26; 160/377, 371, 381, 378; 119/20

[56] References Cited

U.S. PATENT DOCUMENTS

| | | | |
|---|---|---|---|
| 1,168,836 | 1/1916 | Vette | 256/25 X |
| 2,532,837 | 12/1950 | De Puy | 160/377 |
| 2,581,318 | 1/1952 | Bartlett | 256/25 X |
| 2,645,540 | 7/1953 | Trimble et al. | 160/378 |
| 3,021,116 | 2/1962 | Querengesser | 256/72 |
| 3,502,330 | 3/1970 | Cheftel | 100/371 UX |
| 4,134,439 | 1/1979 | Scott | 160/377 X |

*Primary Examiner*—Andrew V. Kundrat
*Attorney, Agent, or Firm*—Schmidt, Johnson, Hovey & Williams

[57] ABSTRACT

An improved, low cost fence panel construction having a variety of uses such as in the erection of dog kennels or the like is provided which can be easily and quickly assembled by unskilled workmen or the home handyman, and which yields a sturdy, structurally sound fence panel. Broadly speaking, the panel construction hereof includes elongated top and bottom rails, along with a pair of upright side rails; the end margins of the rails are configured for telescopic interfitting thereof so as to present an interconnected, continuous panel perimeter. A section of fencing fabric of appropriate dimensions is secured to the perimeter-defining rails, in order to complete the overall panel and to subject the telescopically interfitted rail members to forces tending to pull the same together. In this fashion the completed panel is structurally self-sustaining and rigidified. A prime advantage of the present invention stems from the fact that costly fence components such as corner members and caps are completely eliminated.

1 Claim, 4 Drawing Figures

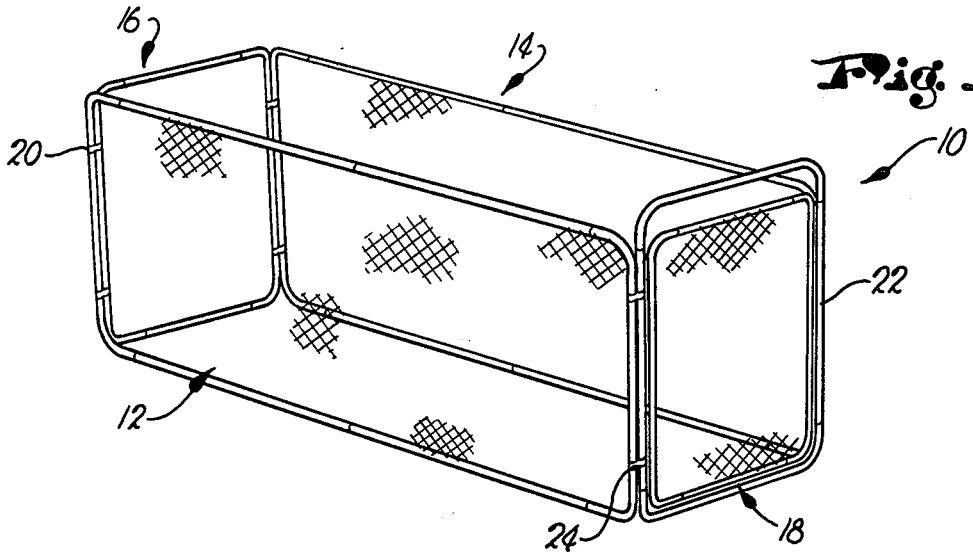
Fig. 1.
Fig. 2.
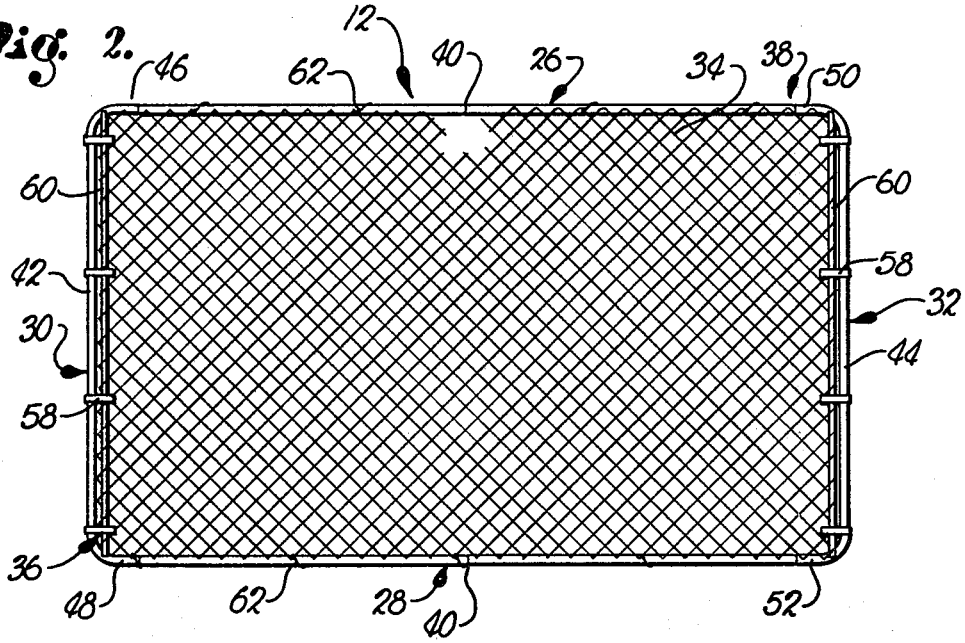
Fig. 3.
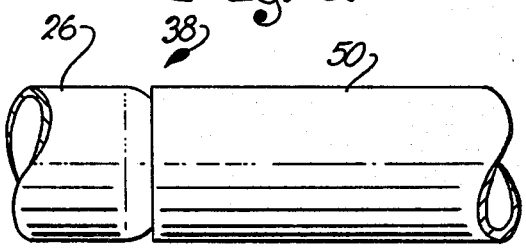
Fig. 4.
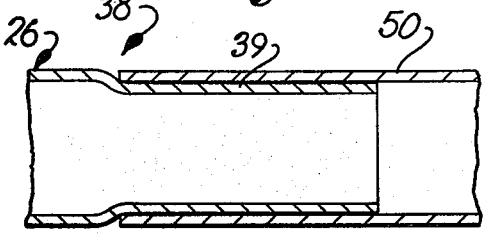

PREFABRICATION FENCE PANEL CONSTRUCTION FOR DOG KENNELS AND THE LIKE

BACKGROUND OF THE INVENTION

1. Field of the Invention

The present invention is broadly concerned with a greatly improved fence panel construction which is low in cost, easily assembled, and structurally superior. More particularly, it is concerned with such a fence panel construction which comprises telescopically interfitted rail members presenting a panel perimeter, along with a section of fencing fabric and secured to the rails in such a manner as to firmly pull the rails together and thereby enhance the structural integrity of the finished panel.

2. Description of the Prior Art

Typical fencing constructions of the woven wire type include spaced apart, upright standards, a top rail extending between the standards, and woven wire fabric secured to the standards and top rail.

While this type of fencing has achieved widespread and long standing commercial acceptance, use thereof in specialized fencing constructions has presented problems. For example, many manufacturers sell fencing kits for the construction of dog kennels or runs. Such kits merely employ the conventional components of standard woven wire fencing which includes numerous specialized corner pieces and other hardware. This inevitably tends to increase the cost of the kennel kit, and moreover increases the complexity of the assembly operation.

There is therefore a decided need in the art for a low cost, easy to assemble fence panel construction which can be sold constructed or in kit form so as to facilitate ultimate construction of a dog kennel or the like.

SUMMARY OF THE INVENTION

The present invention overcomes the problems noted above and provides a fence panel construction having a top rail, a bottom rail, and a pair of upright side rails. The end margins of the top, bottom and side rails are integral with the corresponding rails and are configured for telescopic interfitting thereof in order to define an interconnected, continuous panel perimeter of desired length and height which is free of conventional corner components or other costly hardware. A section of fencing fabric is secured to the interconnected perimeter-defining rails, in a manner of subjecting the telescopically interfitted rail ends to forces tending to pull the rails together; in this fashion the completed panel construction is inherently strong and structurally self-sustaining.

Preferably, the side rails are configured with bent upper and lower ends, and the adjacent top and bottom rails, have reduced diameter ends so that the latter fit into and align with the bent ends of the side rails. The fencing fabric used in the invention is most advantageously conventional woven wire fabric.

BRIEF DESCRIPTION OF THE DRAWING

FIG. 1 is a perspective view of a dog kennel constructed using a total of four fence panel constructions in accordance with the invention;

FIG. 2 is an elevational view of a completed fence panel in accordance with the invention;

FIG. 3 is an enlarged, fragmentary view illustrating the interfitting of a pair of perimeter-defining rails; and FIG. 4 is a vertical sectional view of the interfitted rails depicted in FIG. 3.

DESCRIPTION OF THE PREFERRED EMBODIMENT

Turning now to the drawing, a dog kennel 10 is illustrated in FIG. 1. The kennel 10 includes front and rear fence panels 12, 14, as well as stationary end panel 16 and swingable door 18. As illustrated, the end panel 16 is rigidly secured to the front and rear panels 12, 14, by means of appropriate connectors 20; on the other hand, the opposed ends of the panels 12, 14, are secured to a continuous door frame 22 by connectors 24. The door 18 is in turn swingably secured to the frame 22 in order to allow access to the interior of kennel 10.

For purposes of illustration, front panel 12 is illustrated in elevation in FIG. 2. Broadly speaking, the panel 12 includes a top rail 26, a bottom rail 28, a pair of side rails 30, 32, woven wire fencing fabric section 34, and connection structure broadly referred to by the numeral 36 for securing the section 34 to the panel perimeter defined by the rails 26–32.

The top and bottom rails 26, 28 are of identical, tubular construction and include opposed end margins 38 having reduced ends as at 39; moreover, in the embodiment shown, the overall rails 26, 28 are each formed of two sections which are telescopically interfitted as at 40.

The side rails 30, 32 are likewise formed of tubular material and include a major upright portion 42, 44 as well as generally horizontally extending upper and lower ends 46, 48 and 50, 52. The extreme innermost ends of the rail ends 46–52 are of a diameter to telescopically receive the adjacent ends 39 of the top and bottom rails 26, 28 (see FIG. 4).

From the foregoing it will be understood that the rails 26–32 cooperatively define and present a perimeter 56 for the overall fence panel construction. That is to say, the opposed, reduced diameter end margins 39 of top rail 26 telescopically interfit within the upper ends 46, 50 of the rails 30, 32, whereas the ends 39 of bottom rail 28 telescopically interfit within the side rail bottom ends 48, 52.

The fencing fabric section 34 is of essentially conventional construction, and is formed of interwoven metallic wire as will be understood by those skilled in the art. Moreover, in the kit for the construction of panel 10, the sections will be advantageously precut to have length and height dimensions substantially the same as those of the perimeter 56.

In order to complete the overall fence panel construction 12, the fabric section 34 is secured to the panel perimeter and stretched so as to pull the perimeter-defining rails together. To this end, a series of connectors 58 are secured to each side rail 30, 32 as illustrated, and are attached to conventional elongated tension rods 60. The rod 60 in turn engage the opposed ends of section 34 and are used, during assembly of panel 12, to stretch the fabric section. Finally, a series of tie wires 62 are employed to secure the upper and lower margins of the section 34 to the top and bottom rails 26, 28.

The construction of panel 12 can be easily accomplished by unskilled workmen or the backyard mechanic. Generally speaking, the construction procedure involves simply telescopically interfitting the perimeter-defining rails 26–32, followed by attaching the fabric section 34 thereto. Although only the construction of panel 12 has been described in detail, those skilled in the art will readily perceive that the remaining panels forming a part of overall kennel 10 are similarly constructed and arranged. Thus, the panels 10, 14 and 16 can be separately constructed and interconnected along with the door frame 22 (which is likewise formed of telescopically interfitted tubular members as illustrated). The door 18 can also be separately constructed in the manner of any of the other panels, and secured to frame 22 by means of conventional hinge structure.

I claim:

1. An upright, free-standing enclosure, comprising:

a plurality of fence panels, each including— a top rail;

a bottom rail;

a pair of upright side rails each having an upper and a lower end;

the end margins of said top, bottom and side rails being integral with the major portion of the corresponding rails and configured for telescopic interfitting of the opposed ends of said top rail with the upper ends of the respective side rails, and for telescopic interfitting of the opposed end of said bottom rail with the lower ends of said respective side rails, to define an interconnected, continuous panel perimeter having a desired length and height;

a section of fencing fabric;

means for securing said fabric section to said interconnected perimeter-defining rails, and for subjecting said telescopically interfitted rail ends to forces tending to pull said top, bottom and side rails together, whereby said panel construction is structurally self-sustaining;

frame structure including telescopically interfitted, top, bottom and side rails presenting a continuous frame circumscribing and defining a gateway;

a gate configured to fit within said frame structure;

hinge means securing said gate within said frame structure; and means rigidly interconnecting adjacent, upright side rails of said plurality of fence panels and said frame structure for presenting a free-standing enclosure free of permanently set posts or the like, including rigid connectors directly coupled to said adjacent side rails and spanning the distance therebetween.

* * * * *